US010207234B2

(12) United States Patent
Ray et al.

(10) Patent No.: US 10,207,234 B2
(45) Date of Patent: Feb. 19, 2019

(54) BLENDING DEVICE FOR BLENDING A SAMPLE IN A SEALABLE BAG

(71) Applicant: Seward, LTD., West Sussex (GB)

(72) Inventors: Stuart Ray, West Sussex (GB); Geoffrey Matthews, West Sussex (GB); John Patrick, West Sussex (GB)

(73) Assignee: Seward, LTD., West Sussex (GB)

( * ) Notice: Subject to any disclaimer, the term of this patent is extended or adjusted under 35 U.S.C. 154(b) by 0 days.

(21) Appl. No.: 15/438,549

(22) Filed: Feb. 21, 2017

(65) Prior Publication Data

US 2017/0157577 A1 Jun. 8, 2017

Related U.S. Application Data

(63) Continuation of application No. 14/038,997, filed on Sep. 27, 2013.

(30) Foreign Application Priority Data

Sep. 28, 2012 (GB) ..... 1217488.4

(51) Int. Cl.
*B01F 11/00* (2006.01)
*B01F 15/00* (2006.01)
(Continued)

(52) U.S. Cl.
CPC ..... *B01F 11/0065* (2013.01); *B01F 3/0853* (2013.01); *B01F 7/00533* (2013.01);
(Continued)

(58) Field of Classification Search
CPC ..... B01F 11/0042; B01F 11/0045; B01F 11/0048; B01F 11/0065; B01F 15/0085
(Continued)

(56) References Cited

U.S. PATENT DOCUMENTS 4,590,850 A * 5/1986 Hedenberg ..... A21B 7/005 99/348
5,146,840 A * 9/1992 Hedenberg ..... A21B 7/005 206/219
(Continued)

FOREIGN PATENT DOCUMENTS

EP 1693072 A1 8/2006
EP 1707939 A1 10/2006
(Continued)

OTHER PUBLICATIONS

Great Britain Search Report for GB 1217488.4 dated Jan. 28, 2013, 5 pages.
(Continued)

*Primary Examiner* — Marc C Howell
(74) *Attorney, Agent, or Firm* — TaeSoo Sean Kim; Nixon Peabody LLP

(57) ABSTRACT

A blending device (2) for blending a sample held in a sealable open mouthed sample bag comprises a bag receiving portion (6). The blending device (2) also includes a kneading arrangement (20) for acting on a wall of a sample bag (8) disposed in the bag receiving portion (6) so as to blend a sample contained in the bag (8). A bag manipulation arrangement (13) or a bag support (28) may also be provided.

23 Claims, 10 Drawing Sheets

(51) Int. Cl.
*B01F 7/00* (2006.01)
*B01F 3/08* (2006.01)

(52) U.S. Cl.
CPC ..... *B01F 11/0082* (2013.01); *B01F 15/0085* (2013.01); *B01F 15/00733* (2013.01)

(58) Field of Classification Search
USPC ..... 366/117, 197, 96
See application file for complete search history.

(56) References Cited

U.S. PATENT DOCUMENTS

| | | | | |
|---|---|---|---|---|
| 5,243,833 | A * | 9/1993 | Coelho | A61M 5/445 165/104.28 |
| 5,788,449 | A | 8/1998 | Riemersma | |
| 8,181,568 | B1 | 5/2012 | Hofman et al. | |
| 8,459,129 | B2 | 6/2013 | Seznec | |
| 2003/0214874 | A1* | 11/2003 | Hlavinka | A61L 2/0011 366/197 |
| 2004/0027916 | A1 | 2/2004 | Lafond et al. | |
| 2007/0140047 | A1* | 6/2007 | Ray | B01F 11/0065 366/197 |
| 2008/0186802 | A1 | 8/2008 | Bungay et al. | |
| 2014/0092702 | A1 | 4/2014 | Ray et al. | |

FOREIGN PATENT DOCUMENTS

| | | | | |
|---|---|---|---|---|
| EP | 2712670 | A2 | 4/2014 | |
| ES | 2374906 | T3 | 9/2011 | |
| FR | 2780786 | A1 | 1/2000 | |
| FR | 2781695 | A1 | 2/2000 | |
| GB | 2506432 | A | 4/2014 | |
| JP | 2004089888 | A | 3/2004 | |
| JP | 2008-083018 | A | 4/2008 | |
| WO | WO 1997/043039 | A1 | 5/1997 | |
| WO | WO 2000/015328 | A1 | 3/2000 | |
| WO | WO 2005/084787 | A1 | 9/2005 | |
| WO | WO 2008/003689 | A1 | 1/2008 | |
| WO | WO 2008/003696 | A1 | 1/2008 | |
| WO | WO 2008003696 | A1 * | 1/2008 | B01F 11/0065 |
| WO | WO 2011/038212 | A1 | 3/2011 | |
| WO | WO 2011/138219 | A1 | 11/2011 | |

OTHER PUBLICATIONS

European Extended Search Report for EP 13185847.4 dated Apr. 5, 2016, 6 pages.
GB 1217488.4 Examination Report dated Mar. 3, 2017, 4 pages.
GB 1711697.1 Examination Report dated Aug. 23, 2017, 5 pages.

* cited by examiner

BLENDING DEVICE FOR BLENDING A SAMPLE IN A SEALABLE BAG

CROSS-REFERENCE TO RELATED APPLICATIONS

This application is a continuation of U.S. patent application Ser. No. 14/038,997, filed on Sep. 27, 2013, currently pending, which also includes a claim of priority under 35 U.S.C. § 119(a) and § 365(b) to British Patent Application No. GB 1217488.4, filed on Sep. 28, 2012, the entirety of which is hereby incorporated by reference.

DISCLOSURE OF THE INVENTION

This invention relates to devices for blending materials e.g. mixing components of a mixture or homogenising single components. The materials may be liquids or semi-liquid matter and in some cases solids or powders or even gases. The invention is particularly concerned with the preparation of samples for bacteriological or chemical testing but may also be used for the preparation of other blended substances.

A known blending device comprises a door which acts as a support for holding a sample bag and reciprocating paddles for acting on the bag. The bag may be placed on the support and then brought into an operating position (by closing the door of the device) to clamp the bag in position and seal the bag. The paddles are arranged to reciprocate alternately pressing on the outer surface of the bag, kneading the contents of the bag to achieve a blending action.

Preparing sample for devices of this type involves inserting a sample into a sample bag, opening the bag manually and adding a suitable quantity of diluent. The bag containing the sample and diluent mixture can then be placed into the blending device. In handling/opening the bag it is possible that contaminants might be introduced into the bag which may adversely affect the subsequent testing. Additionally, the time taken between the introduction of the diluent into the bag and the transport of the bag to the blending device means that the interior of the bag is exposed to potential contaminants from the environment. This is undesirable.

When the bag is inserted into the blending device the bottom of the bag typically rests under gravity against a bag support. As the door of the device is closed the bottom of the bag will remain against this bag support unless an operator remembers to lift the bag slightly just before closing the door. Attempting to homogenise the contents of the bag whilst the bottom of the bag is resting against the bag support could potentially mean that thorough mixing does not occur.

Closing the door of the device seals the bag. A drawback with this arrangement is that the blending device is limited to homogenising samples within sample bags that are sized such that they extend from the bag support a sufficient distance to enable sealing of the bag by closing the door. If a small sample is used occupying only a small portion of the bottom of the bag the same sized sample bag must nonetheless be used. This is wasteful of the material used to make the sample bag. It may also result in a mere wetting of the interior of the sample bag if the sample is very small.

Further, during operation of the blending device, it is possible that a portion of the sample, diluent or some other contaminant matter enters the blending space within the blending device. This may occur due to spillage from or rupture of the bag during a homogenising process. In such circumstances the blending space will need to be cleaned. Whilst the door of such blending devices is openable so as to provide access to this space, the presence of the reciprocating paddles hinders the thorough cleaning of the space.

It is an object of the present invention to provide an improved blending device which alleviates at least some of the problems of the prior art.

According to an aspect of the present invention, there is provided a blending device for blending a sample held in a sealable open mouthed sample bag, the device comprising a bag receiving portion for receiving a sample bag carrying a sample, and kneading means for acting on a wall of a sample bag disposed in the bag receiving portion so as to blend a carried sample.

According to another aspect of the present invention, there is provided a blending device for blending a sample held in a sealable open mouthed sample bag, the device comprising a bag receiving portion for receiving a sample bag carrying a sample, kneading means for acting on a wall of a sample bag disposed in the bag receiving portion so as to blend a carried sample, and bag manipulation means including holding means for holding a sample bag in an open position whilst in the bag receiving portion.

The blending device may be arranged such that a sample bag may be disposed in an operative kneading position as the holding means holds the sample bag in an open position.

The blending device may comprise a body. The bag receiving portion may be disposed in a fixed position relative to the body.

The bag receiving portion may comprise a carrier support surface arranged for supporting a sample bag. The carrier support surface may also provide a surface against which the kneading means may be arranged to act, through walls of a sample bag. The bag receiving portion may comprise a bag support for supporting a bottom of a sample bag.

The ability to hold a sample bag in an open position whilst in the bag receiving portion enables material to be added to the sample bag in this location which allows a more efficient blending process.

The blending device may comprise a bag manipulation means for manipulating a state of a sample bag received in the bag receiving portion. The bag manipulation means may comprise the holding means.

The bag manipulation means may comprise a sealing means for sealing a sample bag disposed in the bag receiving portion. The sealing means may comprise two sealing members defining therebetween a sealing region in which material of the bag may be clamped to effect sealing.

A first sealing member and a second sealing member may be arranged to be movable relative to one another between an unsealed position and a sealed position in which the sealing members cooperate across the sealing region for sealing a bag disposed in the sealing region. The sealing members may be arranged to be adjacent one another in the sealed position.

The holding means may be arranged for movement relative to the bag receiving portion between a retracted position in which the holding means is spaced apart from the bag receiving portion and an extended position in which the holding means is located adjacent the bag receiving portion for holding a sample bag disposed in the bag receiving portion.

The bag manipulation means may comprise a mounting means to which the holding means is mountable, and a controlling means coupled to the mounting means for controlling movement of the holding means relative to the bag receiving portion between the retracted and extended positions.

The holding means may comprise a first abutment member and a second abutment member for abutting against a wall of a sample bag in use so as to hold the sample bag. The first abutment member and the second abutment member may be arranged to be movable relative to one another.

In the retracted position the first and second abutment members may be spaced apart from the bag receiving portion. In the extended position the first and second abutment members may be located adjacent the bag receiving portion for abutting against a wall of a sample bag. In the extended position the first and second abutment members may be located adjacent the carrier support surface.

The holding means may comprise driving means for driving the first and second abutment members relative to one another. The driving means may be arranged for driving the first and second abutment members relative to one another so as, in the extended position of the holding means, to open the sample bag. For example, the driving means may be arranged to drive the first and second abutment members so as to decrease the distance between the abutment members.

The driving means may be arranged to drive the first and second abutment members so as to increase the distance between the abutment members before decreasing the distance between the abutment members.

The movement of the first and/or the second abutment member may be arranged to cause a corresponding movement of a wall of a sample bag against which the respective abutment member abuts. Thus, as the distance between the first and second abutment members decreases, the wall of the sample bag that is abutted by the abutment members will tend to bend or distort away from the other wall into a ripple or wave shape. The other wall of the sample bag remains substantially flat. The top portions of the two walls of the bag therefore become spaced from each other, opening the sample bag.

Thus the holding means, in the extended position, allows the abutment members to abut a wall of the bag, and move apart to straighten the wall of the bag before moving towards one another to open the bag. This can increase the ease and/or repeatability of the opening process. It may also increase the controllability of the opening process.

This arrangement of the bag manipulation means facilitates the opening of a sample bag in a blending device without contacting the interior of the bag. This avoids the introduction of contaminants into the bag. This restricts the possibility for cross-contamination between samples and/or between sample bags used in a blending device.

The driving means may comprise a plurality of arms, wherein the first abutment member may be located towards an end of a first arm and the second abutment member may be located towards an end of a second arm. The driving means may comprise cam arms. The first abutment member may be mounted to the first arm by a first cam arm. The second abutment member may be mounted to the second arm by a second cam arm. At least one of the first cam arm and the second cam arm may be pivotally mounted to the respective arm.

The first abutment member may comprise a first roller. The second abutment member may comprise a second roller. At least one of the first and second rollers may be rotatably supported on the respective arm. The first and/or second roller may be rotatably supported on the respective cam arm.

The blending device may be arranged such that the bag manipulation means is resiliently abuttable against a wall of a sample bag disposed in the bag receiving portion. Preferably the holding means is arranged to resiliently abut a wall of a sample bag disposed in the bag receiving portion. Preferably, at least one of the first abutment member and the second abutment member is arranged to resiliently abut a wall of a sample bag. The first abutment member and/or the second abutment member may be of a resilient material. The first and/or the second cam arm may be arranged to resiliently mount the respective abutment member to the respective arm.

At least one of the first and second rollers may be arranged to rotate. Thus the rollers may rotate slightly when in contact with the wall of the bag.

At least one of the first and second rollers may be generally cylindrical and supported on the respective arm, either directly or via for example the respective cam arm, such that an outer curved part of the surface of the roller is arranged to abut against a wall of a bag located in the bag receiving portion.

The first and second rollers may be of different sizes. The first and second cam arms may be of different sizes. In this way, the abutment members may be arranged to move asymmetrically when abutting the wall of the bag. Such asymmetric movement of the abutment members can assist in the opening of the sample bag. For example, the asymmetric movement can assist in causing the rippling in the wall of the bag to form such that one large ripple is preferentially formed. This increases the size of the opening.

The or each roller may comprise ridges for enhancing friction between the roller and a wall of a bag.

The or each abutment member may comprise a friction enhancing material for enhancing friction between the abutment member and a wall of a bag. The or each abutment member may be formed from a friction enhancing material. In this way the or each abutment member can be arranged to minimise slipping of the abutment member against a wall of a bag.

The carrier support surface may comprise a friction enhancing material for enhancing friction between the carrier support surface and a wall of a bag. The carrier support surface may be provided with a coating of a friction enhancing material. The carrier support surface may be formed from a friction enhancing material. In this way, the carrier support surface can be arranged to minimise slipping of the carrier support surface against a wall of a bag.

Thus, as the abutment members are driven relative to one another so as to cause one wall of the bag to bend or ripple, the frictional contact between the carrier support surface and the other wall of the bag restricts the other wall of the bag from similarly bending or rippling. This assists in opening the bag.

The friction enhancing material may be a plastics based paint. The friction enhancing material may cooperate with static on a surface of a bag so as to enhance frictional contact with a wall of a sample bag.

The first arm and the second arm may be mounted to the mounting means such that they are relatively movable thereto between a first position and a second position, wherein the abutment members are spaced further apart from one another in the first position than in the second position. The first and second arms may be pivotally mounted to the mounting means.

The driving means may comprise at least one arm biasing means for biasing at least one of the first arm and the second arm towards the first position. The arm biasing means may be coupled to the mounting means. Preferably both of the first arm and the second arm are biased towards the first position. The arm biasing means may be a spring. The arm biasing means may be a helical spring.

The mounting means may be slidably movable relative to the bag receiving portion. The controlling means may be arranged to cause sliding movement of the mounting means relative to the bag receiving portion. Thus the controlling means may be arranged to cause movement of the holding means between the retracted and the extended position. The controlling means may comprise a piston.

The driving means may comprise a lever arm, to which the first arm and the second arm may be coupled, the lever arm being pivotally mounted to the mounting means such that pivoting of the lever arm relative to the mounting means is arranged to cause the first and second arms to move between the first position and the second position. The arm biasing means may be coupled to the lever arm and arranged to bias the first arm and the second arm towards the first position.

The driving means may comprise a trigger arm, which trigger arm may be provided towards one end of the lever arm, the trigger arm being pivotally coupled to the lever arm such that the trigger arm is movable between a rest position and a rotated position. Relative pivotal movement between the trigger arm and the lever arm may have a defined end point at the rest position beyond which the trigger arm will not pivot relative to the lever arm further in a first pivotal direction. The driving means may comprise a trigger biasing means for biasing the trigger arm in the first pivotal direction towards the rest position. The trigger biasing means may be a spring.

The mounting means may comprise a first mounting portion and a second mounting portion arranged for relative movement therebetween. The holding means may be provided on the first mounting portion. The second mounting portion may comprise coupling means for coupling movement of the controlling means to the holding means.

The coupling means may be arranged to permit relative movement between the first mounting portion and the second mounting portion. The coupling means may be arranged to permit the first mounting portion and the second mounting portion to move together. The second mounting portion may be movable in a first direction relative to the first mounting portion and in an opposite second direction relative to the first mounting portion.

The mounting means may be arranged such that movement of the second mounting portion in the first direction causes the coupling means to cause the driving means to move from the first position to the second position. The mounting means may be arranged such that movement of the second mounting portion in the second direction causes the coupling means to cause the driving means to move from the second position to the first position.

The coupling means may be arranged to act on the trigger arm such that, as the second mounting portion is moved in the first direction relative to the first mounting portion, the coupling means causes relative pivotal movement between the lever arm and the mounting means.

The coupling means may be a peg extending from the second mounting portion. The first mounting portion may comprise a slot within which the peg is receivable and is arranged to move. The peg may be arranged to contact the trigger arm as the peg moves relative to the slot.

The mounting means may be arranged such that movement of the second mounting portion in the first direction causes the coupling means to contact the trigger arm urging the trigger arm in the first pivotal direction from the rest position so as to cause movement of the trigger arm and the lever arm together, which movement is arranged to cause the first arm and the second arm to move from the first position to the second position.

The coupling means and/or the trigger arm may be arranged such that further movement of the second mounting portion in the first direction causes the coupling means to come out of contact with the trigger arm, causing the first arm and the second arm to move from the second position to the first position under the action of the arm biasing means. For example, the coupling means may come out of contact with the trigger arm by moving past the trigger arm.

The bag manipulation means may comprise a guide portion for guiding a portion of a wall of a sample bag. For example, the guide portion can guide a bend or ripple in a wall of a sample bag. Thus, the opening of the sample bag may be consistently located. The guide portion may be a guiding recess in the holding means. The guiding recess may be provided between the first and second arms.

The blending device may comprise a diluent dispensing arrangement. The diluent dispensing arrangement may comprise a reservoir for receiving a source of diluent, a dispensing nozzle and a fluid connection path between the reservoir and the dispensing nozzle. A pump may be provided in the diluent dispensing arrangement for causing dispensing of diluent from the dispensing nozzle. The pump may be a peristaltic pump. The dispensing nozzle may be movable relative to the bag receiving portion. The dispensing nozzle may be arranged for dispensing diluent towards the bag receiving portion. The dispensing nozzle may be arranged to dispense diluent into a sample bag disposed in the bag receiving portion and held by the holding means.

The blending device may be arranged such that relative movement of the mounting means and the bag receiving portion towards one another seals a bag disposed in the bag receiving portion. The mounting means may comprise a first sealing member and the bag receiving portion may comprise a second sealing member, the first and second sealing members being arranged to cooperate for sealing a bag. The carrier support surface may comprise the second sealing member. The mounting means may be arranged for movement relative to the bag receiving portion such that the first and second sealing members are locatable adjacent one another thereby forming a sealing region therebetween, for sealing a bag.

At least a first of the sealing members of the sealing means may comprise at least one projecting portion and a second of the sealing members of the sealing means may comprise at least one complementary receiving recess to provide a convoluted sealing region into which material of a bag will be drawn during clamping so tending to draw a remainder of the bag towards the sealing means.

According to another aspect of the present invention, there is provided a blending device for blending a sample held in a sealable open mouthed sample bag, the device comprising a bag receiving portion for receiving a sample bag carrying a sample, kneading means for acting on a wall of a sample bag disposed in the bag receiving portion so as to blend a carried sample, and sealing means for sealing a bag disposed in the bag receiving portion, the sealing means comprising two sealing members defining therebetween a sealing region in which material of the bag may be clamped to effect sealing, wherein at least a first of the sealing members comprises at least one projecting portion and a second of the sealing members comprises at least one complementary receiving recess to provide a convoluted sealing region into which material of a bag will be drawn during clamping so tending to draw a remainder of the bag towards the sealing means.

The action of drawing a remainder of the bag towards the sealing means on clamping of the bag will cause the bottom of the bag to be drawn towards the sealing means. In this way, the bottom of the bag will be raised away from the bag support on which the bag rests in the unclamped state. This improves the mixing within the bag during blending.

The operation of the sealing means to both seal the bag and raise the bottom of the bag away from the bag support improves consistency in the location of the bag during blending and avoids the need for an operator to remember to adjust the bag prior to starting the blending process.

The projecting portion may comprise a rib, and the receiving recess may comprise an elongate recess with a generally U-shape cross-section. The rib of the projecting portion may be arranged to project into the elongate recess, akin to a tongue-and-groove joint. On clamping a wall of a bag between the sealing members, the material of the wall of the bag is drawn into the elongate recess and wraps at least partly around the projecting portion as the projecting portion projects into the elongate recess.

The blending device may comprise a control system for controlling at least one operation of the blending device such that when a sample bag containing a sample is disposed in the bag receiving portion, the control system is able to control a complete blending operation. The control system may control the bag manipulation means for acting on a sample bag disposed in the bag receiving portion. For example, the control system may control at least the holding means for controlling the opening of a bag. The control system may control the diluent dispensing arrangement so as to control the dispensing of diluent. The control system may control the sealing means for controlling the sealing of a bag.

The control system may be arranged to control at least one of moving the holding means from the retracted position to the extended position, moving the arms from the first position to the second position, dispensing diluent from the dispensing nozzle, and moving the first sealing member relative to the second sealing member so as to define a sealing region in which material of a bag may be clamped.

The control system may comprise a programmable and/or user operable control.

Whilst the above aspects have been described separately, it is to be understood that the blending device may comprise any feature or combination of features of any of the above aspects with any feature or combination of features of any of the other aspects.

The blending device of any of the aspects may comprise any one of or any combination of the following additional features.

The kneading means may comprise at least one reciprocating paddle. The reciprocating paddle may be arranged for acting on a wall of a sample bag disposed in the bag receiving portion. The paddle may comprise a flat kneading surface.

The paddle may comprise a paddle arm arranged for mounting the paddle to a reciprocating mechanism.

The paddle arm may comprise a paddle arm mounting means. The paddle arm mounting means may be arranged such that the paddle is releaseably mountable to and removable from the reciprocating mechanism, for example by a user. One of the paddle arm mounting means and a portion of the reciprocating mechanism may comprise a protrusion, and the other of the paddle arm mounting means and a portion of the reciprocating mechanism may comprise a recess, the protrusion being arranged to be receivable into the recess. For example, the paddle may be mountable to the reciprocating mechanism via a dovetail joint. The dovetail joint may be oriented substantially vertically for retaining a protrusion on the paddle arm mounting means in a recess on the reciprocating mechanism under the action of gravity.

Thus the paddles may be quickly and easily removed for cleaning and/or replaced for example with paddles of a different size or configuration.

The bag support may be adjustable. The bag support may comprise adjustment means for adjusting the height of the bag support relative to the body of the blending device. In this way the bag support can be adjusted such that it can accept bags of different sizes thereon whilst retaining the ability of the sealing means to seal the bag.

The bag support may be magnetically mounted to the body of the blending device. For example, the bag support may be magnetically mounted to the carrier support surface. At least one of the bag support and the carrier support surface may comprise a magnet for magnetically mounting the bag support to the body. At least one of the bag support and the carrier support surface may be formed of a magnetic material. The magnet or magnetic material may be a ceramic magnet.

Adjusting the bag support in this manner may necessitate replacing the paddles of the blending device with differently sized or configured paddles.

Alternatively if it is desired to use differently sized or configured paddles the bag support may be adjusted to position a sample bag accordingly such that thorough mixing may still occur.

An adjustable bag support may be provided in addition to a fixed bag support.

During the blending process the kneading means may apply a kneading action to the carrier support surface. This may occur, for example, as the kneading means acts on a wall of a sample bag whilst the sample bag is supported against the carrier support surface. The carrier support surface may be smooth. The avoidance of irregularities in the carrier support surface may help avoid the rupture of a sample bag during the blending process, or the causing of damage to the kneading means.

According to another aspect of the present invention, there is provided a blending device as defined above, the blending device being provided with a sample bag disposed in the bag receiving portion.

An embodiment of the invention will now be described with reference to the accompanying drawings in which.

Figure 1:
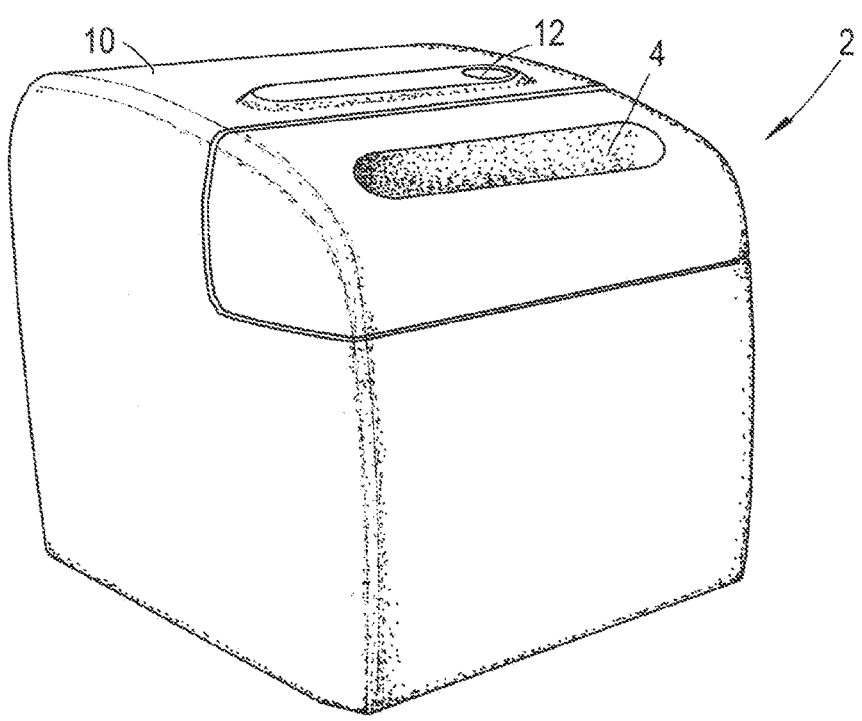
FIG. 1 shows a blending device.
Figure 2:
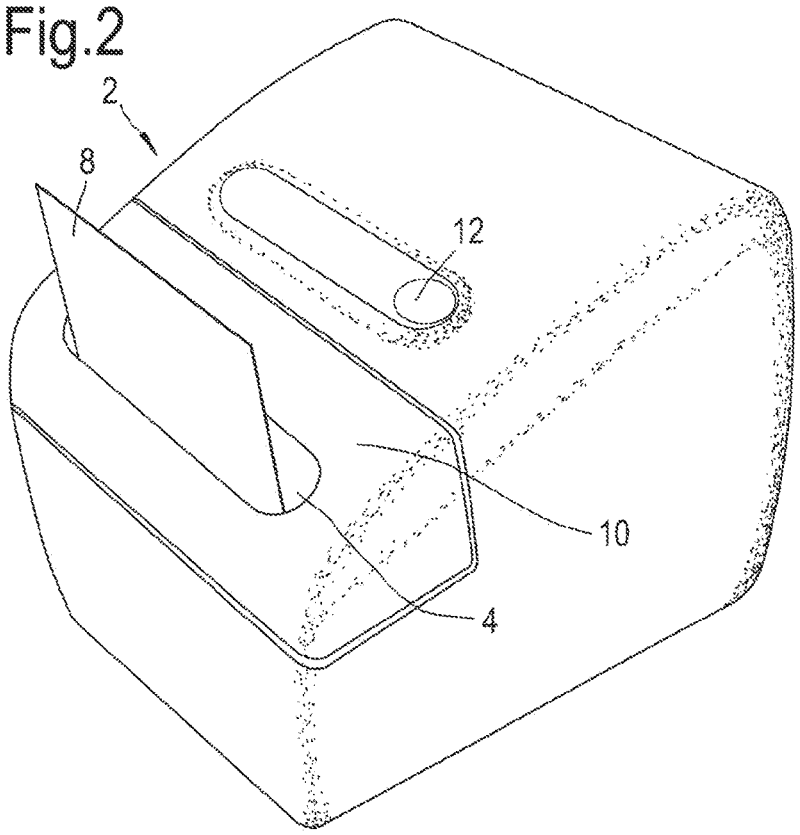
FIG. 2 shows the blending device of FIG. 1 with a sample bag being inserted into the blending device.
Figure 3:
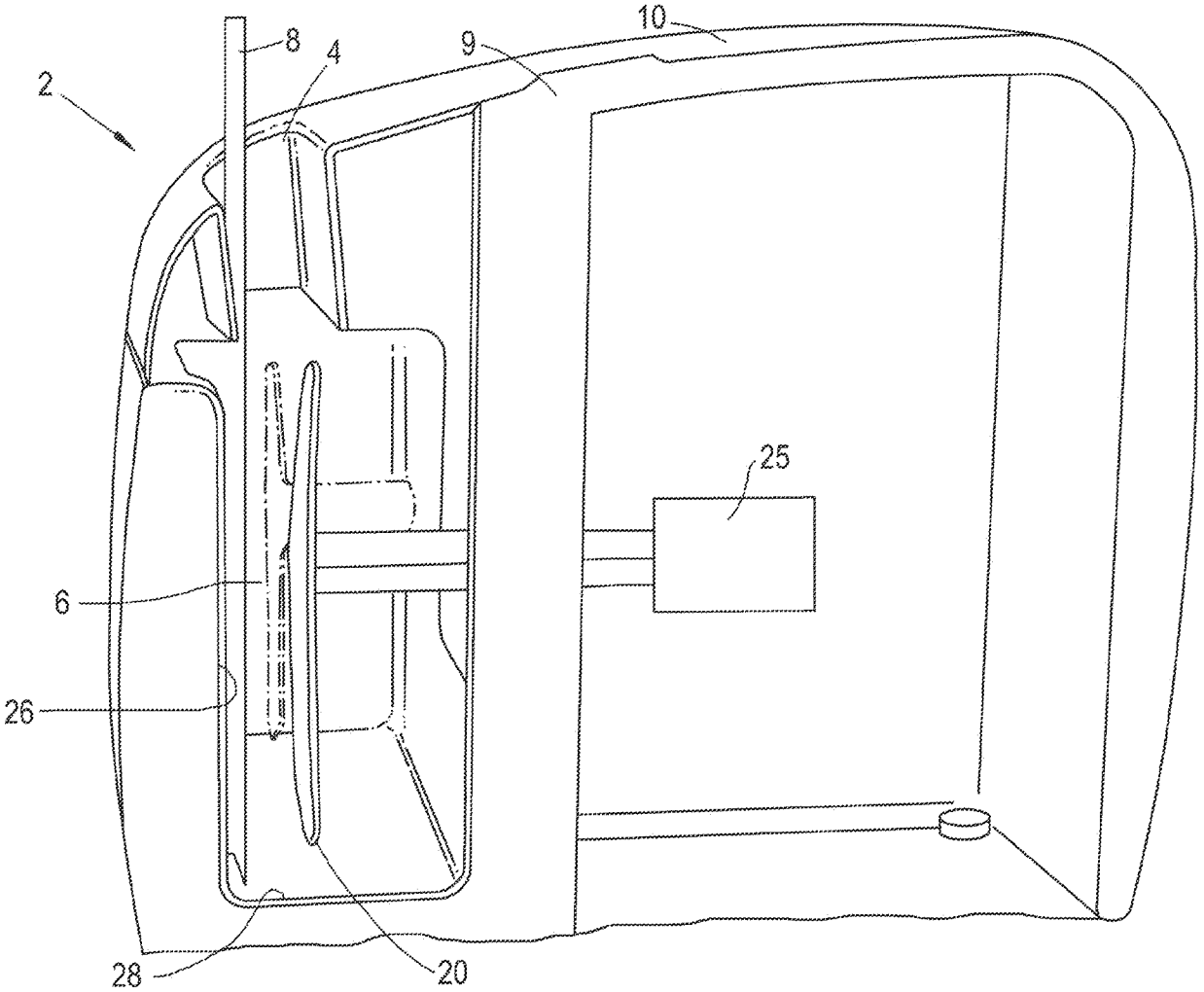
FIG. 3 shows a schematic cut-away of the blending device of FIG. 1.

FIGS. 1 and 2 show a blending device 2 for blending a sample held in a sealable open mouthed sample bag. It is to be understood that the sample bag may be sealed by opposing walls of the bag being pressed or clamped together to at least temporarily seal the bag. The blending device 2 comprises a bag receiving portion 6 for receiving a sample bag 8. Referring to FIG. 3, the blending device 2 comprises a kneading means 20 for applying a kneading action to walls of the sample bag 8. A reciprocating mechanism 25 (shown schematically) for reciprocatingly driving the kneading means is provided in a body 9 of the blending device 2.

The blending device 2 further comprises a bag manipulation means 13 for manipulating a state of a sample bag 8 received in the bag receiving portion 6. A diluent dispensing arrangement 16 is provided for dispensing diluent. The bag manipulation means comprises a holding means 14 for holding a sample bag 8 whilst in the bag receiving portion 6, and a sealing means 18 for sealing a bag disposed in the bag receiving portion 6.

The diluent dispensing arrangement 16 advantageously dispenses diluent into a sample bag 8 as the bag is held by the holding means 14.

A control system 12 is provided for controlling operation of the blending device 2 such that when a sample bag 8 containing a sample is disposed in the bag receiving portion 6, the control system 12 is able to control a complete blending operation.

As shown in FIG. 1, the blending device 2 comprises an aperture 4 in an upper surface 10 of the blending device 2. The bag receiving portion 6 is accessed via the aperture 4. In use a sample bag 8 is placed into the blending device 2 via the aperture 4 and is positioned in the bag receiving portion 6 under the action of gravity.

Referring to FIG. 3, the bag receiving portion 6 comprises a carrier support surface 26 for supporting a sample bag 8 disposed in the bag receiving portion 6. The bag receiving portion 6 comprises a bag support 28 at a lowermost portion for supporting the bottom of a sample bag 8.

A sample bag 8 containing a sample to be blended can be disposed in the bag receiving portion 6 and held in an open position by the holding means 14. When held open in this manner, the diluent dispensing arrangement 16 can dispense diluent into the sample bag 8. The bag can be sealed by the sealing means 18, and the contents blended by the action of the kneading means 20.

Figure 4:
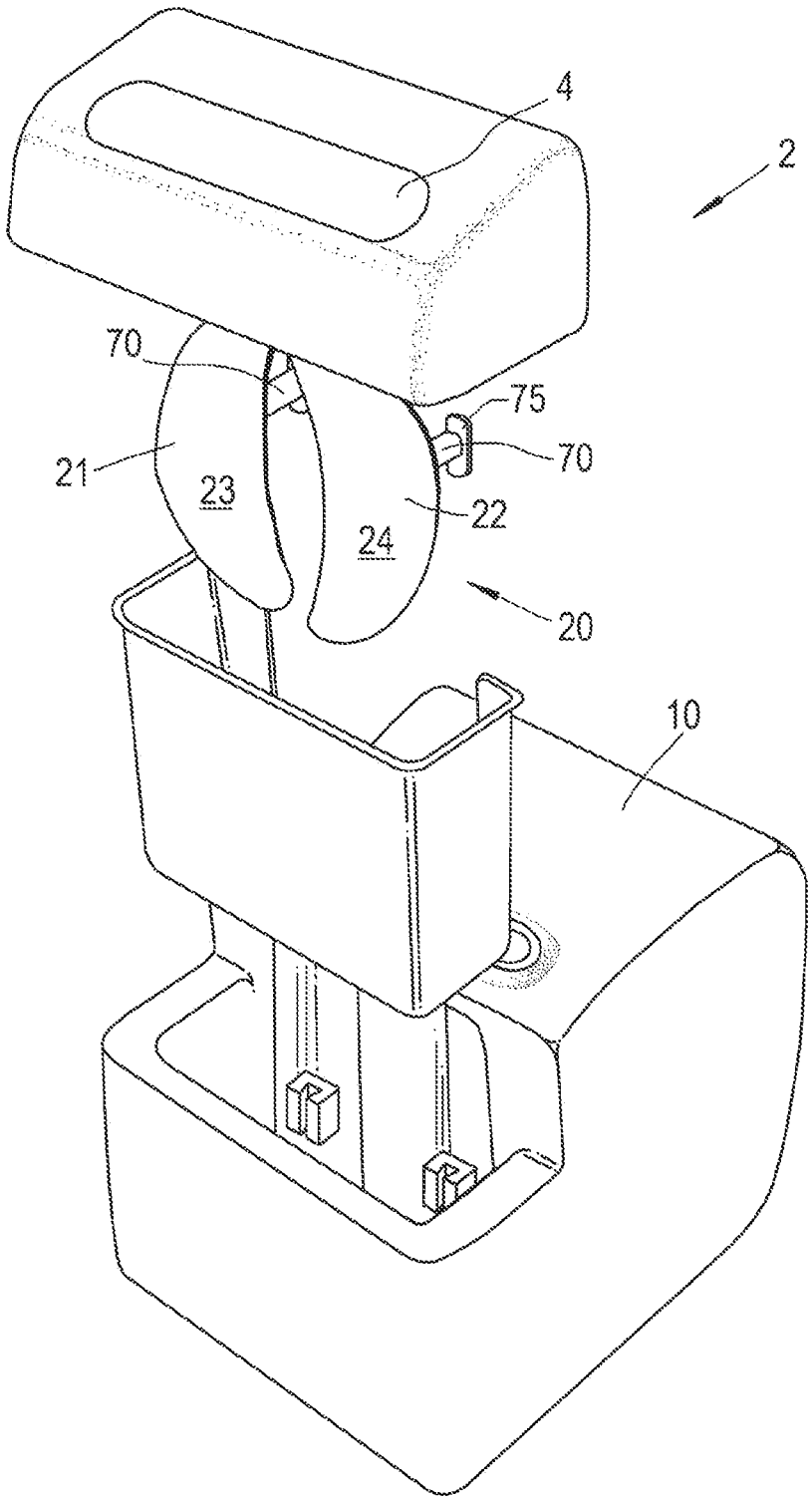
FIG. 4 shows a schematic exploded view of the blending device of FIG. 1.

The kneading means 20 comprises a first and a second paddle 21,22 (FIG. 4). The first paddle 21 and the second paddle 22 are connected to a reciprocating mechanism 25 for reciprocatingly driving the first paddle 21 and the second paddle 22 in a direction which is substantially perpendicular to a kneading surface 23 of the first paddle 21 and a kneading surface 24 of the second paddle 22.

The paddles 21,22 are arranged to act against the carrier support surface 26 so as to blend the contents of the sample bag 8 located in the bag receiving portion 6. The carrier support surface 26 is smooth and cooperates with the flat kneading surfaces 23,24 of the first and second paddles 21,22. The smooth nature of the carrier support surface 26 avoids rupture of a sample bag 8 during a blending process and also avoids potential damage to the paddles 21,22.

Figure 7:
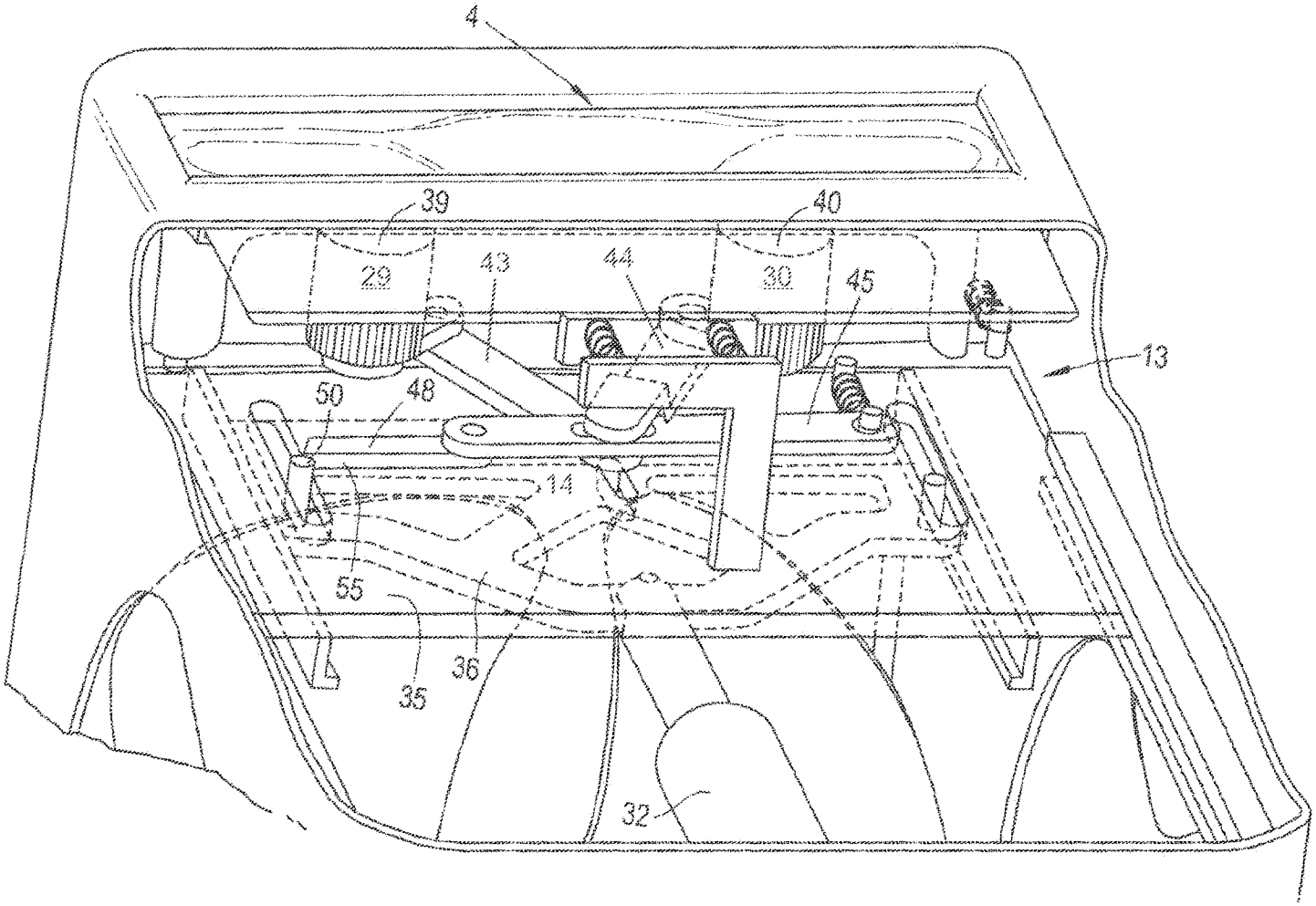
FIGS. 7 to 9 show further views of the blending device as shown in FIG. 6 with a part of the blending device in different states.

As mentioned above, the holding means 14 enables the opening of the sample bag 8 located in the bag receiving portion 6 so that material can be added to the sample bag 8 whilst the sample bag 8 is within the blending device 2. The holding means 14 comprises a first abutment member 29 and a second abutment member 30 for abutting against a wall of a sample bag 8 in use as shown in FIG. 7.

The holding means 14 is movable relative to the bag receiving portion 6 between a retracted position (shown in FIG. 6) in which the first and second abutment members 29,30 are spaced apart from the bag receiving portion 6 and an extended position (shown in FIG. 7) in which the first and second abutment members 29,30 are located adjacent the bag receiving portion 6 for abutting against a wall of a sample bag 8. In the extended position the first and second abutment members 29,30 are located adjacent the carrier support surface 26.

The bag manipulation means 13 comprises a controlling means 32 for controlling movement of the holding means 14 between the retracted and extended positions.

The holding means 14 comprises a driving means 43,44, 45 for driving the first and second abutment members relative to one another.

The driving means 43,44,45 is arranged to drive the first and second abutment members 29,30 so as to decrease the distance between the abutment members 29,30. In the extended position of the holding means 14, the sample bag 8 is opened as the distance between the abutment members 29,30 is decreased.

The driving means 43,44,45 is arranged to drive the first and second abutment members 29,30 so as to increase the distance between the abutment members 29,30 before decreasing the distance between the abutment members 29,30. This straightens a wall of the sample bag 8 before opening the bag.

The bag manipulation means 13 comprises a mounting means 34 for mounting of the holding means 14. The mounting means 34 is slidable in the body 9 of the blending device 2 relative to the bag receiving portion 6. The controlling means 32 is arranged to control movement of the mounting means 34. In the embodiment shown, the controlling means comprises a piston 32.

The piston 32 is coupled to the mounting means 34.

The mounting means 34 comprises a first mounting portion 35 and a second mounting portion 36 arranged for movement relative to one another. The driving means 43,44, 45 is provided on the first mounting portion 35. The second mounting portion 36 comprises coupling means 50 for coupling movement of the controlling means to the driving means 43,44,45.

Figure 6:
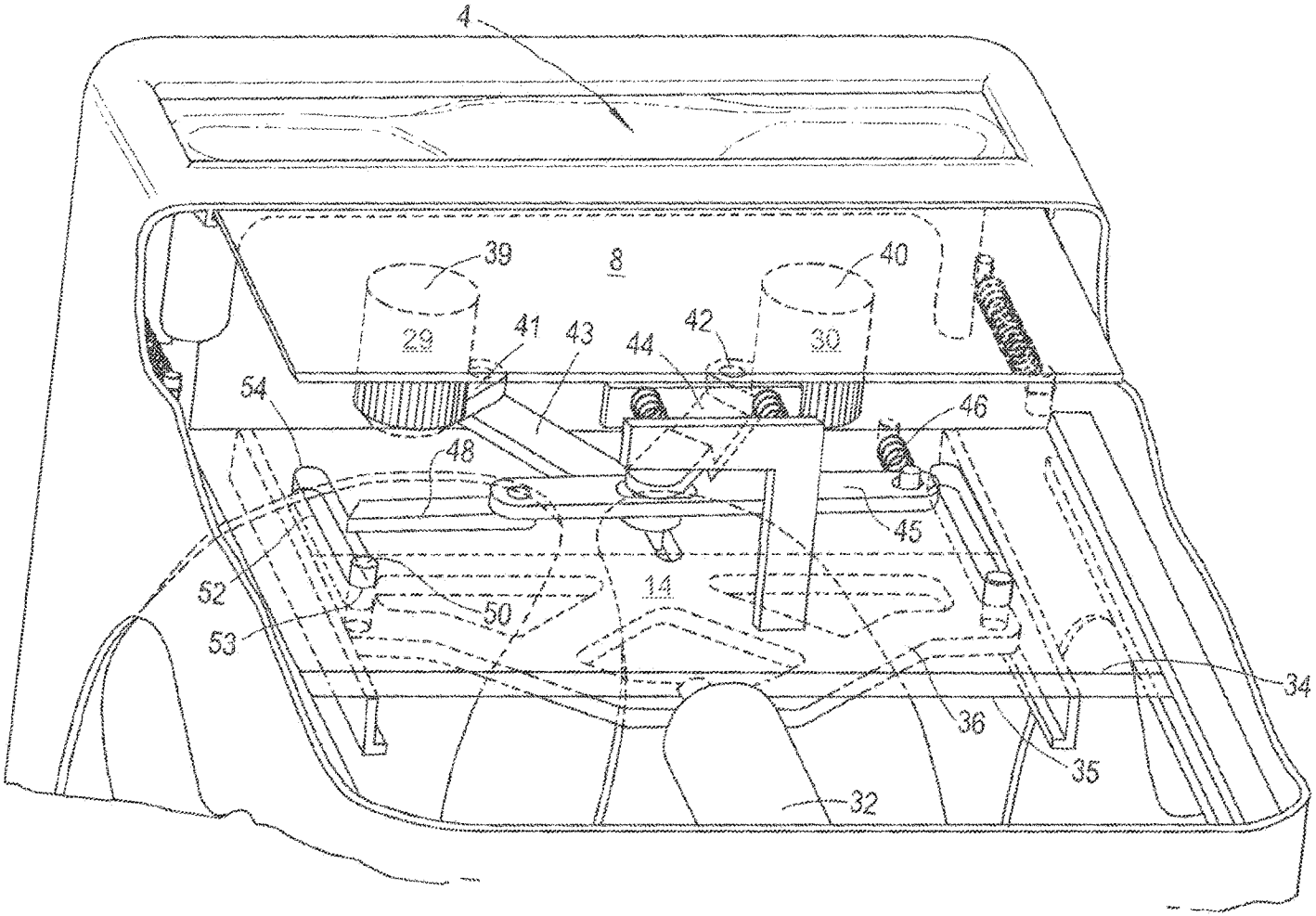
FIG. 6 shows an alternative view of the blending device of FIG. 1 with part of the housing cut-away.

Referring to FIG. 6, the abutment members are first and second rollers 39,40. The driving means comprises first and second cam arms 41,42, and first and second arms 43,44. The rollers 39,40 are mounted to the mounting means 34 via the cam arms 41,42 and the arms 43,44 and are moveable relative to the bag receiving portion 6 by the driving means.

The first and second arms 43,44 are mounted to a lever arm 45. The lever arm 45 is also part of the driving means. The rollers 39,40 are rotatably supported on the cam arms 41,42 and the cam arms 41,42 are pivotally supported on the first and second arms 43,44.

The cam arms 41,42 are biased relative to the first and second arms 43,44 such that under the action of a biasing force the first and second rollers 39,40 will tend to move towards the bag receiving portion 6.

The first arm 43 and the second arm 44 are mounted to the mounting means 34 such that they are moveable between a first position and a second position such that the first and second rollers 39,40 are spaced further apart from one another in the first position than in the second position.

The lever arm 45 is pivotally mounted to the first mounting portion 35 such that pivoting of the lever arm 45 relative to the first mounting portion 35 causes the first and second arms 43,44 to move between the first position and the second position.

The driving means comprises an arm biasing means 46 for biasing the first arm 43 and the second arm 44 towards the first position. In the embodiment shown the biasing means is a helical spring 46. As can be seen from FIG. 6, the arm biasing means 46 is coupled to the lever arm 45, the biasing of which in turn biases the first and second arms 43,44. The arm biasing means 46 is also coupled to the mounting means 34.

The coupling means 50 is arranged to cause the driving means to drive the abutment members 29,30 between the first and the second position. The coupling means 50 is coupled to the driving means by a trigger arm 48.

Referring to FIGS. 6 to 9, the trigger arm 48 is provided towards one end of the lever arm 45 and is pivotally coupled to the lever arm 45. The trigger arm 48 is moveable between a rest position and a rotated position. The relative pivotal movement between the trigger arm 48 and the lever arm 45 has a defined end point at the rest position such that when the trigger arm 48 is in the rest position it will not pivot relative to the lever arm 45 further in a first pivotal direction. The holding means 14 comprises a trigger biasing means (not shown), for example a spring, for biasing the trigger arm 48 towards the rest position.

Thus the trigger arm 48 is pivotable relative to the lever arm 45 towards the rest position. Once in the rest position, the trigger arm 48 will not pivot relative to the lever arm 45 further in the first pivotal direction. As the coupling means 50 attempts to pivot the trigger arm 48 in the first pivotal direction beyond the rest position, the trigger arm 48 and lever arm 45 pivot together in the first pivotal direction. The trigger arm 48 remains free to pivot relative to the lever arm 45 in a second pivotal direction, the second pivotal direction being opposite to the first pivotal direction.

In the retracted position (FIG. 6) the first roller 39 and the second roller 40 are spaced apart from the carrier support surface 26. In this position a sample bag 8 may be inserted into or removed from the bag receiving portion 6.

In the extended position (FIG. 7) the first and second rollers 39,40 are located adjacent the carrier support surface 26 and are arranged for abutting against the wall of the sample bag 8 located in the bag receiving portion 6.

The first and second arms 43,44, together with the lever arm 45 and the trigger arm 48, are mounted to the first mounting portion 35. The piston 32 is coupled to the second mounting portion 36. The second mounting portion 36 comprises a peg 50 for coupling the second mounting portion 36 to the first mounting portion 35. The first mounting portion 35 comprises a slot 52 within which the peg 50 is arranged to move as the second mounting portion 36 and the first mounting portion 35 move relative to one another.

In the retracted position (shown in FIG. 6) the peg 50 is located towards a first end 53 of the slot 52. In this position the second mounting portion 36 is movable relative to the first mounting portion 35 in a first direction such that the peg 50 moves along the slot 52 towards a second end 54 of the slot 52. The second mounting portion 36 is also movable relative to the first mounting portion 35 in an opposite second direction such that the peg 50 is movable along the slot 52 towards the first end 53 of the slot 52.

Figure 8:
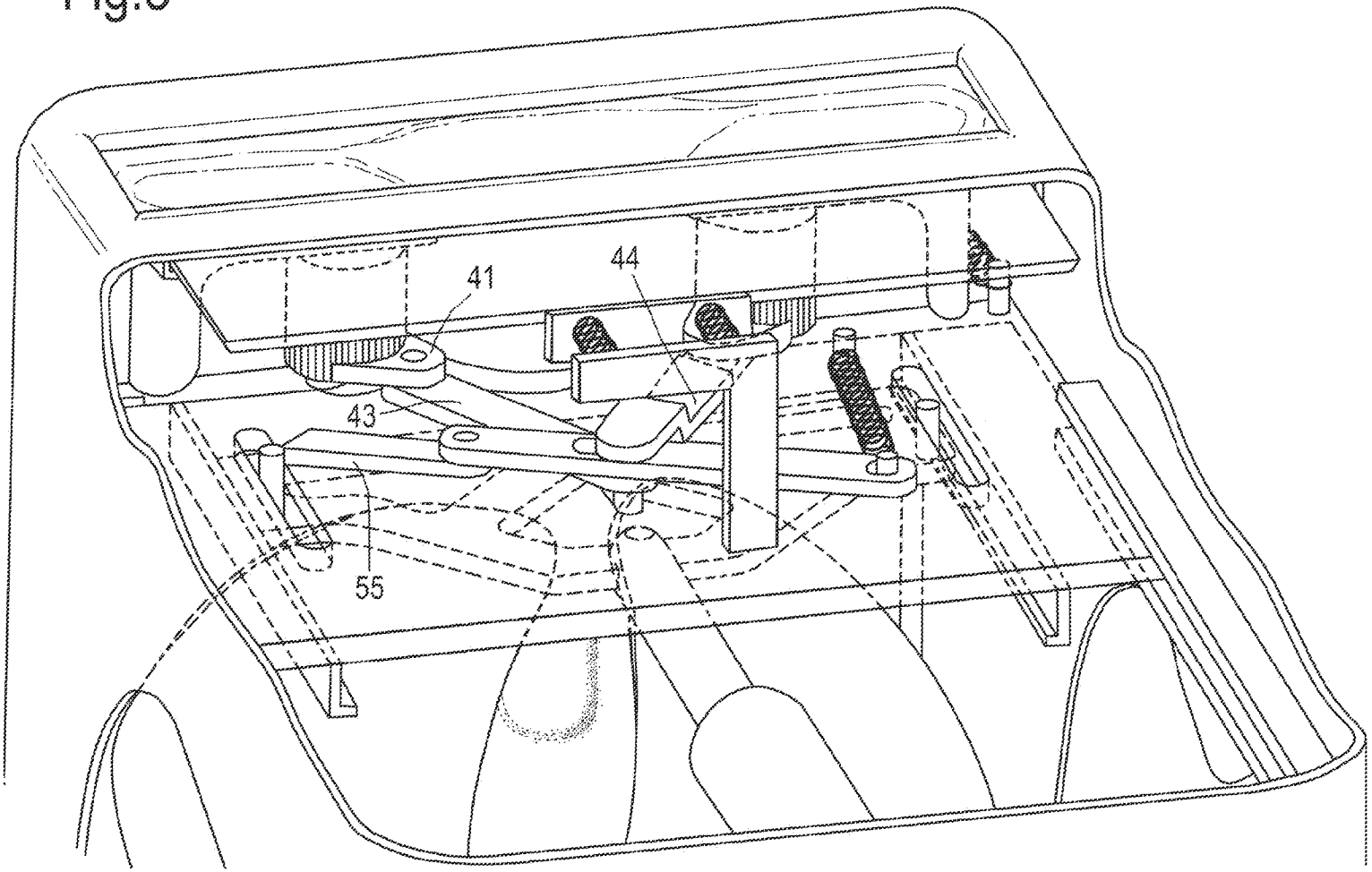

In the retracted position, the trigger arm 48 is in the rest position. The trigger arm 48 projects across the slot 52 such that as the peg 50 moves along the slot 52 towards the second end 54 of the slot 52 the peg 50 will move into contact with a first side 55 of the trigger arm 48 (as shown in FIG. 7). As the peg 50 contacts the trigger arm 48 it will urge the trigger arm 48 in the first pivotal direction. This causes the trigger arm 48 and lever arm 45 to pivot together relative to the first mounting portion 35 (as shown in FIG. 8).

When the peg 50 moves from the second end 54 of the slot 52 towards the first end 53, the peg 50 will move into contact with a second side 56 of the trigger arm 48, opposite to the first side 55. This contact on the second side 56 will urge the trigger arm 48 to pivot in a direction opposite the first pivotal direction. Thus the trigger arm 48 will pivot relative to the lever arm 45 and will not cause the lever arm 45 to pivot relative to the first mounting portion 35.

As mentioned above, once a sample bag 8 has been inserted into the blending device 2 such that it is located at the bag receiving portion 6 it is desirable to open the sample bag 8 so that additional material such as diluent can be inserted into the sample bag 8 prior to the blending process. The operation of the holding means 14 for opening and holding the bag will now be described.

From the retracted position the piston 32 is actuated so as to move the holding means 14 into the extended position so that the first and second rollers 39,40 resiliently abut against a wall of the sample bag 8 in the bag receiving portion 6. On contacting the wall of the bag 8 the rollers 39,40 move outwardly slightly due to rotation of the first and second cam arms 41,42.

The outward movement of the rollers 39,40 slightly away from one another on contacting the wall of the bag 8 causes the material of the wall to become straightened prior to the opening process. This increases the ease and repeatability of the opening process and also increases the controllability of the opening process.

Further actuation of the piston 32 effects movement of the second mounting portion 36 relative to the first mounting portion 35. Thus the peg 50 will move along the slot 52 from the first end 53 towards the second end 54. As the peg 50 moves along the slot 52 it contacts the first side 55 of the trigger arm 48 causing the trigger arm 48 and lever arm 45 to pivot together relative to the first mounting portion 35 (FIG. 8). The pivoting of the lever arm 45 acts against the biasing by the arm biasing means 46 and causes the first arm 43 and the second arm 44 to pivot relative to the first mounting portion 35 such that the respective ends of the first arm 43 and the second arm 44 supporting the rollers 39,40 via the cam arms 41,42 move towards one another. In this way the rollers 39,40 are drawn together. The rollers 39,40 remain in contact with a wall of the bag 8 and as the rollers 39,40 are drawn together the material of the bag 8 is also drawn together with the rollers 39,40.

The rollers 39,40 are generally cylindrical and are arranged such that an outer curved surface 58 abuts against the wall of the bag 8. The rollers 39,40 comprise ridges provided along the curved surface 58 in an axial direction so as to enhance friction between the rollers 39,40 and the wall of the bag 8. Advantageously, the rollers 39,40 comprise a friction enhancing material, such as a plastics based paint, for enhancing the friction between the rollers 39,40 and a wall of a sample bag 8.

In the bag receiving portion 6, one wall of the sample bag 8 rests against the carrier support surface 26 and the other wall of the sample bag 8 is abutted by the first and second rollers 39,40. As the first and second rollers 39,40 are moved towards one another they cause the material of the wall of the bag 8 abutted by the first and second rollers 39,40 to ripple and bend. The wall of the bag 8 resting against the carrier support surface 26 maintains frictional contact with the carrier support surface 26 and does not ripple or bend. Thus the rippling or bending of one wall of the bag 8 causes an opening 60 to be provided at the upper end of the bag 8.

Advantageously, the carrier support surface 26 comprises a friction enhancing material, such as a plastics based paint for enhancing the friction between the carrier support surface 26 and a wall of a sample bag 8. In this embodiment the carrier support surface 26 is coated with a plastics based paint.

Whilst not shown it is preferable if the movement of the first and second rollers 39,40 is asymmetrical i.e. such that the movement of each roller relative to the carrier support surface 26 is not the same. Such asymmetric movement has the advantage of causing a single ripple or bend to be preferentially provided in the wall of the bag 8 such that a single large opening 60 is provided in the sample bag.

The asymmetric opening may be caused by asymmetric movement of the first and second arms 43,44 and/or the first and second cam arms 41,42 and/or due to differently sized first and second rollers 39,40.

The bag manipulation means comprises a guiding recess 62 which is provided such that the ripple or bend of the material of one wall of the bag 8 projects into the guiding recess 62. This causes the location of the opening 60 to be more consistently located.

In this embodiment the guiding recess 62 is provided such that the opening 60 in the sample bag 8 is located underneath a portion of the diluent dispensing arrangement 16. The guiding recess 62 is provided in the holding means 14.

Figure 10:
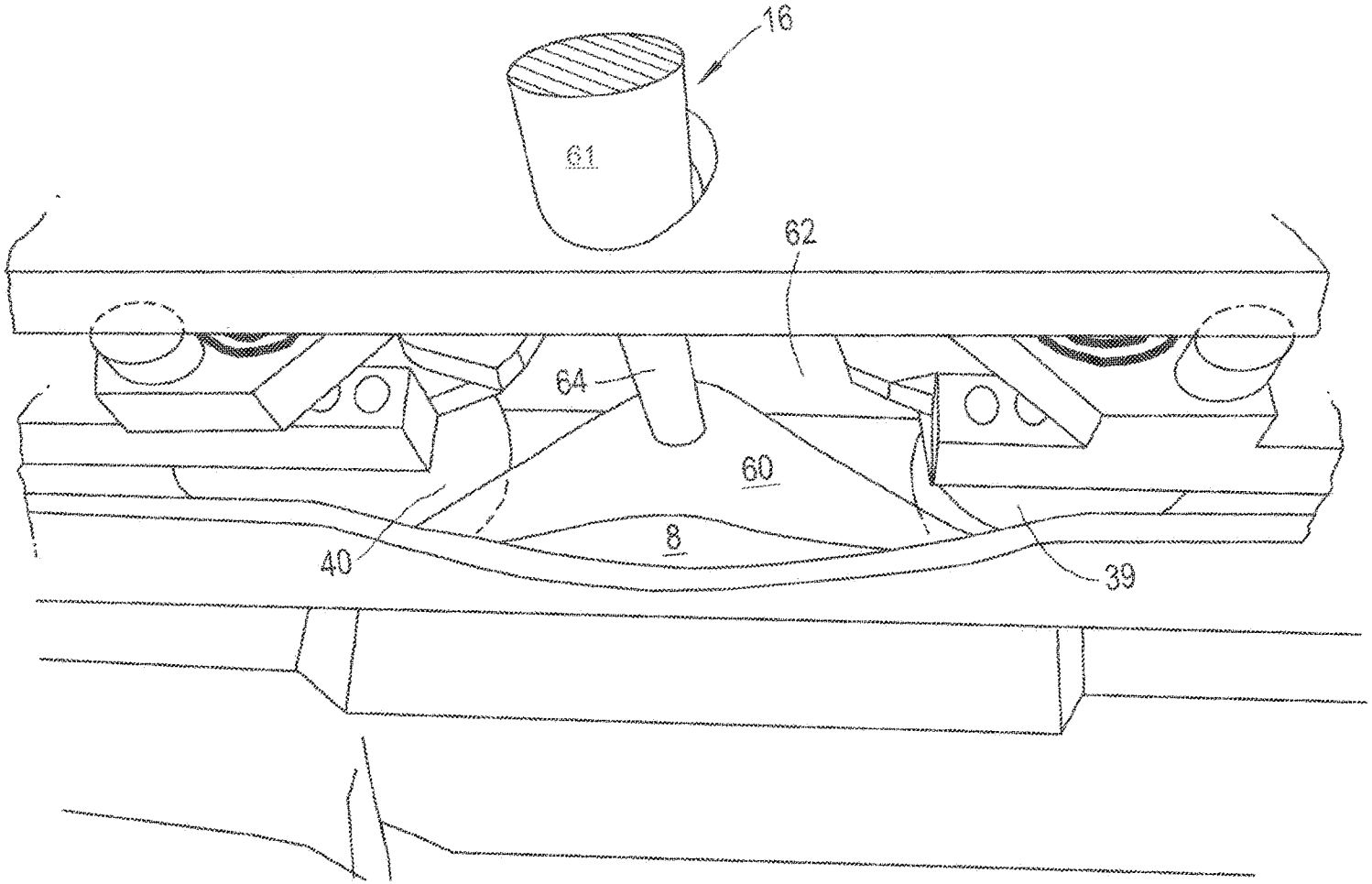
FIG. 10 shows a schematic view of part of the blending device.
Figure 11:
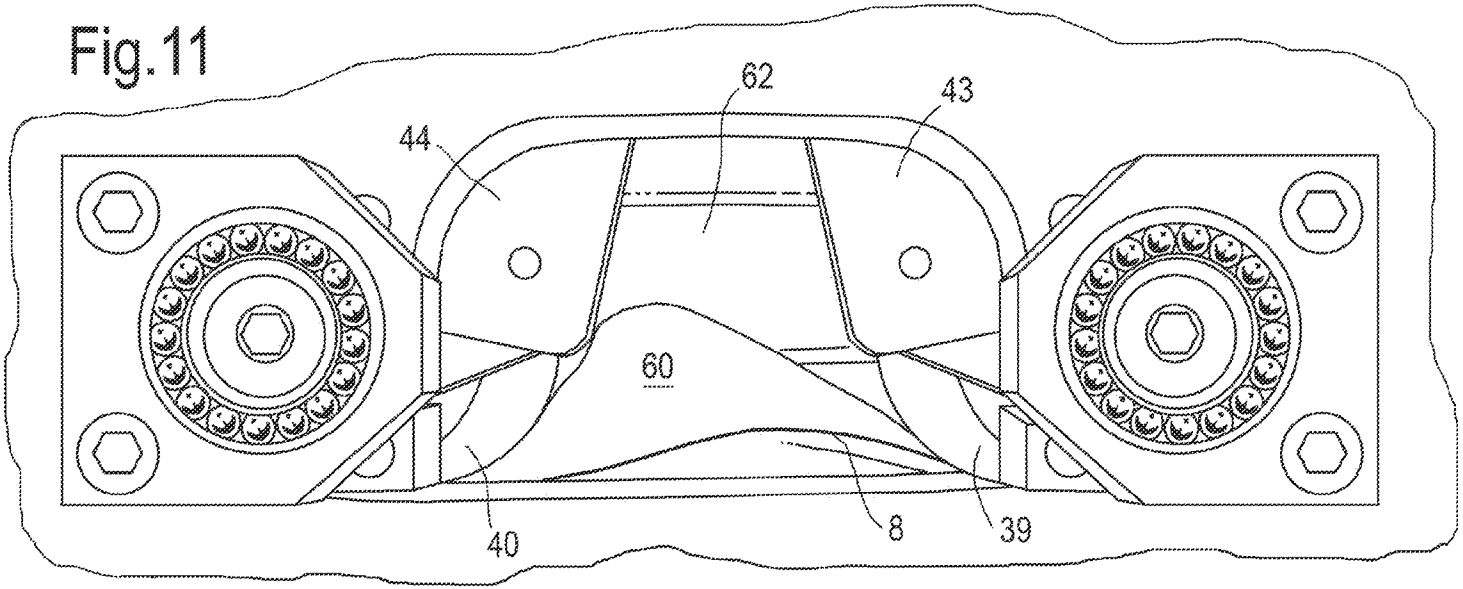
FIG. 11 shows a schematic view of another part of the blending device.

Referring to FIG. 10, a portion of the diluent dispensing arrangement 16 is provided on the mounting means 34 such that it moves together with the mounting means 34 when opening the sample bag 8. It will be appreciated that the diluent dispensing arrangement 16 may be independent of the mounting means 34.

The diluent dispensing arrangement 16 comprises a reservoir for receiving a source of diluent (not shown), a dispensing nozzle 64 and a fluid communication between the dispensing nozzle and the reservoir (not shown). The diluent dispensing arrangement 16 further comprises a pump (not shown), such as a peristaltic pump, for pumping diluent from the reservoir to the diluent dispensing nozzle 64.

The dispensing nozzle 64 is located above the guiding recess 62 and is arranged to be spaced above the top of a sample bag 8. Thus as a sample bag 8 is opened by the holding means 14 the dispensing nozzle 64 will be located above the opening 60 but spaced therefrom such that there is no contact between the dispensing nozzle 64 and the sample bag 8. The location of the dispensing nozzle 64 above the opening 60 in the sample bag 8 allows a simple dispensing of diluent into the sample bag 8. The spacing between the sample bag 8 and the dispensing nozzle 64 avoids cross-contamination between different sample bags.

An operator of the blending device 2 may use the control system 12 to control the amount of diluent to be added to the sample bag 8. This may be done such that a desired ratio between a sample to be blended and diluent is achieved in the sample bag.

In an alternative embodiment the blending device 2 comprises a gravimetric detector for determining the mass of the sample in the sample bag 8. The amount of diluent required for a pre-set ratio of sample to diluent can then be provided by the diluent dispensing arrangement 16 without further interaction by an operator of the blending device 2.

In another embodiment the mass of the sample within a sample bag 8 can be determined by gravimetric detection, such as by weighing the sample and/or sample bag, away from the blending device 2. A label can be attached to an exterior of the sample bag 8 comprising an encoding of the measured mass. The blending device 2 may comprise a label reader for reading and decoding the measured mass and may be arranged to dispense sufficient diluent into the bag to achieve a pre-set ratio of sample to diluent without further interaction by an operator of the blending device 2. In one embodiment the label comprises a barcode and the blending device 2 comprises a barcode scanner.

Once the diluent dispensing arrangement 16 has dispensed sufficient diluent into the sample bag 8 the pump is stopped such that the diluent dispensing arrangement 16 stops dispensing diluent from the dispensing nozzle 64.

Figure 9:
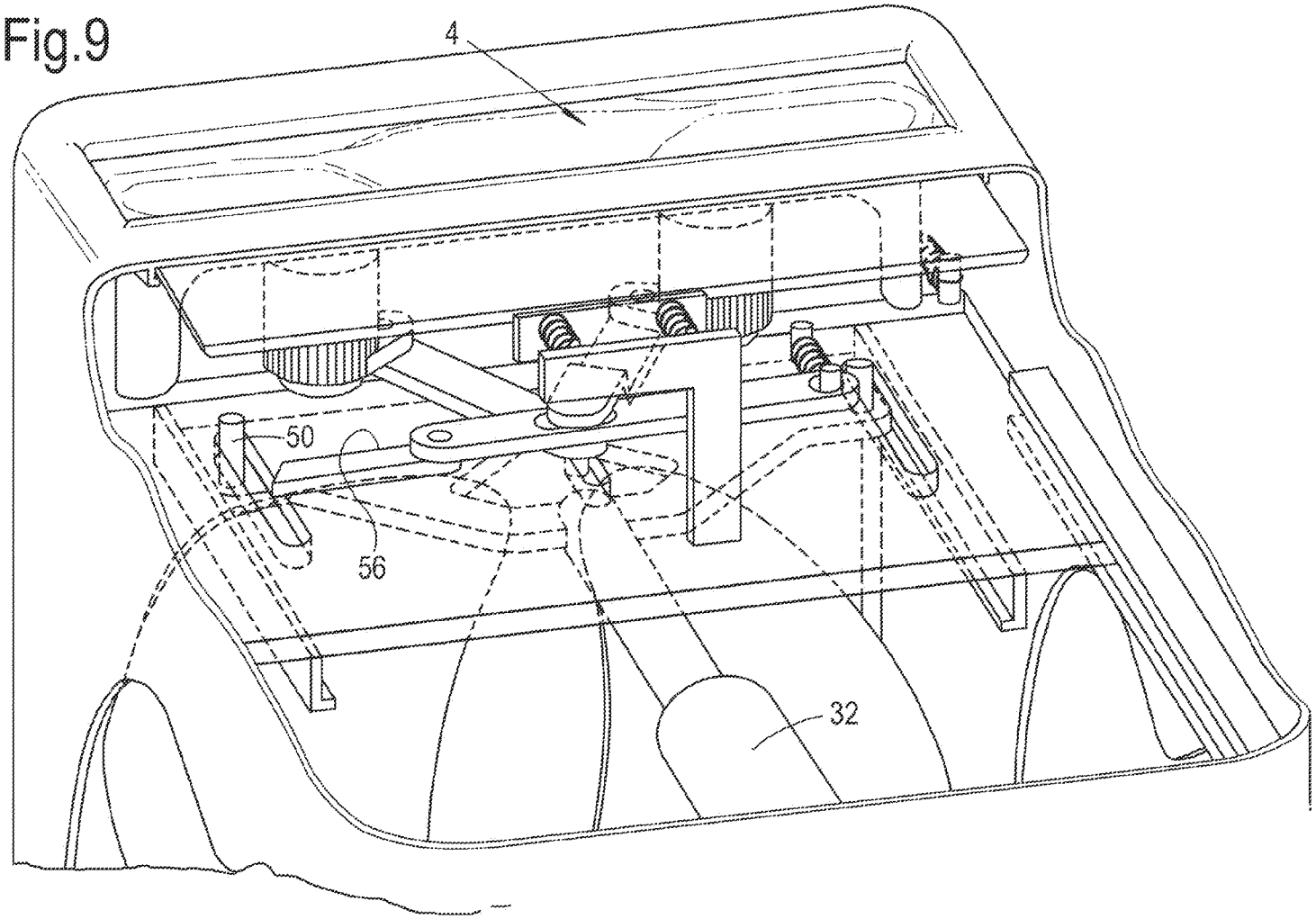

The piston 32 may be actuated to drive the second mounting portion 36 further in a direction towards the bag receiving portion 6. In this way the peg 50 may slide past the end of the trigger arm 48 towards the second end 54 of the slot 52 such that the trigger arm 48 and lever arm 45 move under action of the arm biasing means 46 back to their rest positions (as shown in FIG. 9). In this way the first and second rollers 39,40 move apart from one another so as to close the sample bag 8.

Further actuation of the piston 32 to drive the second mounting portion 36 towards the bag receiving portion 6 results in the peg 50 contacting the second end 54 of the slot 52 in the first mounting portion 35. This causes the first mounting portion 35 to move together with the second mounting portion 36 as the piston 32 is further actuated in the same direction.

Figure 12:
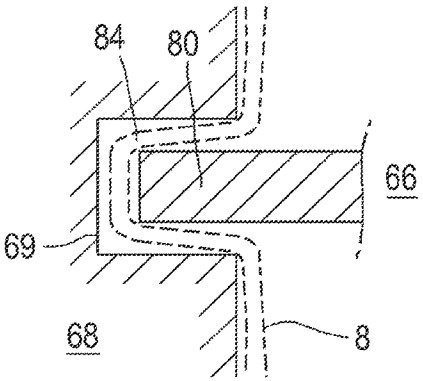
FIG. 12 shows a schematic of the sealing means of the blending device.

As mentioned above, the sealing means comprises a first sealing member and a second sealing member. The mounting means 34 comprises the first sealing member 66 disposed on a portion of the mounting means 34 towards the bag receiving portion 6. Referring to FIG. 12, the first sealing member 66 comprises a projecting portion 80. The second sealing member is provided at the bag receiving portion 6 on a portion of the carrier support surface 26. The second sealing member 68 comprises a receiving recess 69 which is complementary to the projecting portion 80 of the first sealing member 66. The first sealing member 66 and the second sealing member 68 are arranged to cooperate to provide a convoluted sealing region 84 for clamping and sealing the bag 8.

As the first sealing member 66 moves towards the second sealing member 68 it first abuts against a wall of the sample bag 8. As it continues to move towards the second sealing member 68 and protrudes at least partially into the receiving recess 69 the material of the bag is moved together with the first sealing member 66 and is caused to adopt a convoluted path 84 between the first and second sealing members 66, 68 such that material of the bag 8 is drawn up as the projecting portion 80 of the first sealing member 66 protrudes into the receiving recess 69 of the second sealing member 68.

The protrusion of the first sealing member 66 into the receiving recess 69 seals the bag 8. The drawing up of material of the bag causes the bottom of the bag to be raised away from the bag support 28. Thus the operation of the sealing means 18 both seals the bag and raises the bag such that more efficient mixing of the contents of the sample bag can be achieved.

After the blending operation has been completed the bag can be unsealed by separating the first sealing member 66 and the second sealing member 68 by withdrawing the mounting means 34 from the bag receiving portion 6 under the action of the piston 32. As the piston 32 is withdrawn, the peg 50 moves in the slot 52 towards the first end 53. As the peg 50 moves it contacts the second side 56 of the trigger arm 48. The trigger arm 48 pivots so as to allow the peg 50 to pass.

When the peg 50 abuts the first end 53 of the slot 52 in the first mounting portion 35 it causes the first mounting portion 35 to move together with the second mounting portion 36. Thus the mounting means 34 is withdrawn from the bag receiving portion 6 and the carrier support surface 26, unsealing the bag, and the holding means is moved to the retracted position. In this position the first and second rollers 39,40 are spaced from the bag receiving portion 6 and the sample bag 8 may be removed from the bag receiving portion 6.

The action of the piston 32 in one direction to open and then clamp and seal the bag 8, and in an opposite direction to unseal the bag and move the holding means 14 away from the bag so that the bag can be accessed provides a smooth means of operation for the blending device 2.

A cover (not shown) may be provided in some embodiments for covering the aperture 4 in the upper surface 10 of the blending device 2. The cover may cover the aperture 4 once the sample bag 8 has been inserted into the bag receiving portion 6. The covering of the aperture 4 has the advantage that the interior of the blending device 2 is then isolated from the environment thus minimising any contaminant that might otherwise be introduced into the sample bag 8. Further, the presence of the cover across the aperture 4 attenuates sound created within the blending device 2 leading to a quieter operation of the blending device 2.

Once the blending process has been completed the cover may be retained in place so as to close the aperture 4 even after the bag 8 has been unsealed. In this way environmental contamination of the interior of the bag 8 is further minimised. The cover may then be opened by an operator immediately prior to removing the sample bag 8 to minimise the amount of time that the contents of the sample bag 8 are exposed to the environment.

In an alternative embodiment a cover may be provided that is arranged to open once a blending process has completed so as to indicate to an operator that the process has finished. This will be of use to an operator when operating the blending device 2, perhaps together with other blending devices, in a batch process as the operator need not monitor the timing of each of the blending processes but will be aware of the end of the blending process upon movement of the cover to the open position. For this purpose the cover may move such that it exposes an underside of the cover which may be provided with a visual indicator such as a luminescent/coloured surface.

In some cases it will be desirable to use sample bags 8 of differing sizes and/or dimensions. In an alternative embodiment (not shown) the bag support 28 is adjustable for accommodating bags of different sizes whilst retaining the ability of the blending device 2 to open and/or seal the bag 8. The adjustable bag support 28 comprises a ceramic magnet. The blending device 2 comprises a magnetic means for cooperation with the ceramic magnet of the adjustable bag support 28. In one embodiment the carrier support surface 26 is magnetic. In this way the adjustable bag support 28 is adjustable relative to the carrier support surface 26 such that the bag receiving portion 6 can accommodate different bag sizes whilst avoiding the need for any fittings or fixtures to be present on the carrier support surface 26. Thus the carrier support surface 26 can remain smooth as required for the kneading action of the kneading means 20 without rupturing the sample bag 8 and/or causing damage to the kneading means 20.

Figure 5:
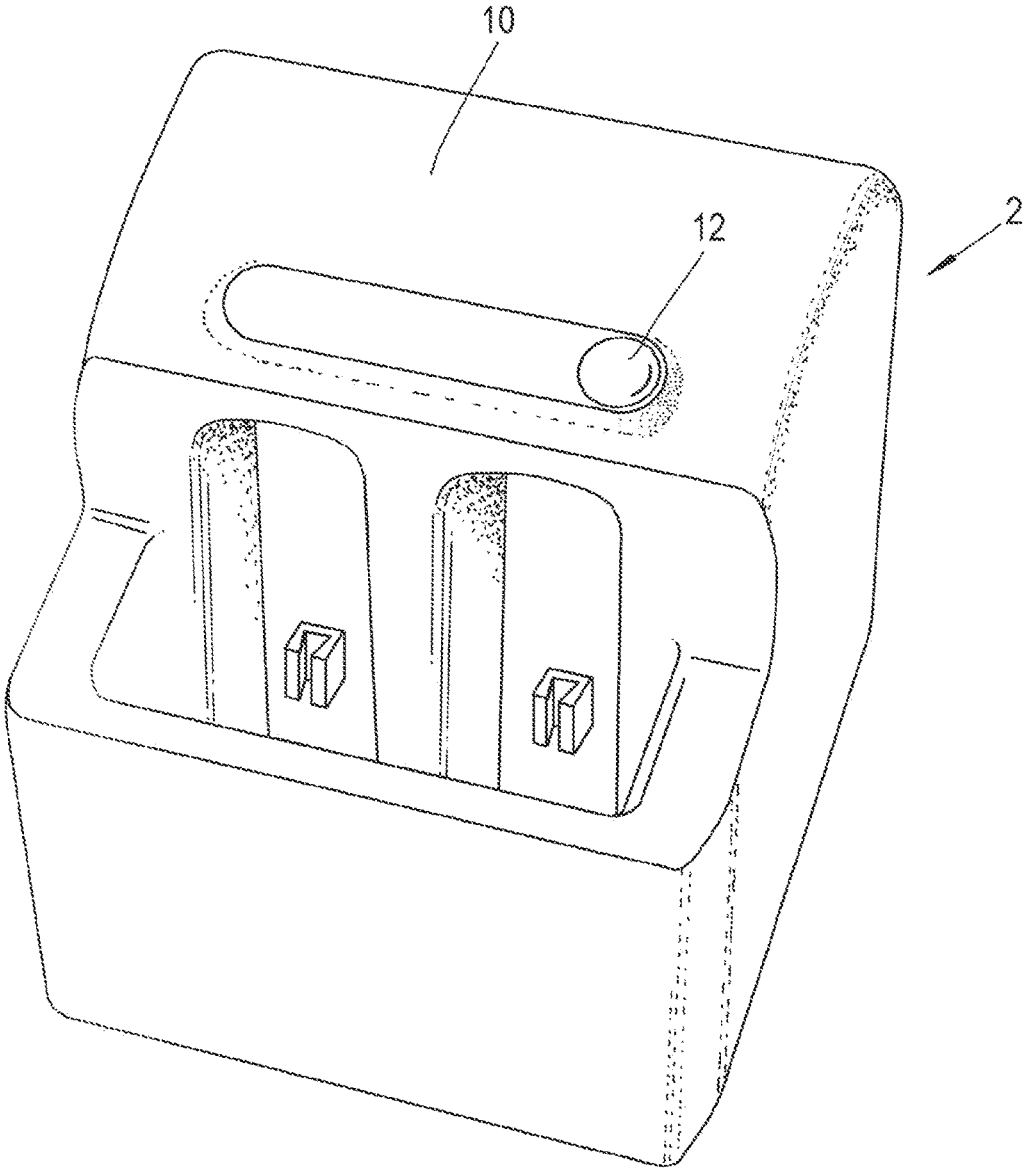
FIG. 5 shows the blending device of FIG. 1 with a portion of the housing removed.

As mentioned the kneading means 20 may comprise at least one paddle 21,22. The paddle 22 may comprise a paddle arm 70 for mounting the paddle 21 to a reciprocating mechanism 25. The paddle 21 may comprise a paddle arm mounting means 75, arranged such that the paddle 21 is releaseably mountable to and removable from the reciprocating mechanism 25. The paddle arm mounting means 75 comprises a protrusion, and a portion of the reciprocating mechanism 25 to which the paddle arm mounting means 75 mounts the paddle 21 comprises a corresponding recess such that the protrusion is receivable into the recess. As can be seen from FIGS. 4 and 5 the paddle 21 is mounted to the reciprocating mechanism 25 via a dovetail joint. The dovetail joint is oriented substantially vertically so that the paddle 21 may be releaseably slotted into the blending device 2 and retained therein under the action of gravity.

The speed and ease of removing the paddles 21,22 facilitated by this arrangement enables a more efficient cleaning of the blending device 2 should, for example, a sample bag rupture or leak or the blending device 2 become otherwise undesirably contaminated. Further, should the blending device 2 be operated with a sample bag of a size or configuration different from a standard sample bag, it may be desirable to change the paddles 21,22 for more efficient mixing of the contents of the sample bag 8. The replacement of the paddles 21,22 with paddles of a different size or configuration allows flexibility in the operation of the blending device 2, for example when homogenising different types of samples and/or when using sample bags of different sizes or shapes.

Thus the arrangement can enable quick and easy modification of the configuration of the blending device 2 to suit the blending requirements.

The invention claimed is:

1. A blending device for blending a sample held in a sealable open mouthed sample bag, the device comprising;

a bag receiving portion for receiving a sample bag carrying the sample, a kneading arrangement for acting on a wall of the sample bag disposed in the bag receiving portion so as to blend a carried sample, and a bag manipulation arrangement including a holding arrangement for holding the sample bag in an open position whilst in the bag receiving portion, wherein the holding arrangement comprises a first abutment member and a second abutment member for abutting against the wall of the sample bag in use so as to hold the sample bag, the first abutment member and the second abutment member being arranged to be movable relative to one another, wherein the holding arrangement comprises a driving arrangement for driving the first and second abutment members relative to one another so as to decrease a distance between the first and second abutment members, and wherein the first and second abutment members are arranged such that when the distance between the first and second abutment members decreases, a first wall of the sample bag that is abutted by the first and second abutment members will tend to bend or distort away from a second wall of the sample bag into a ripple or wave shape, whilst the second wall of the sample bag remains flat, such that the top portions of the walls of the bag become spaced from each other, thereby opening the sample bag so that the sample bag accepts additional material.

2. The blending device as claimed in claim 1, the bag manipulation arrangement comprising a sealing arrangement for sealing the sample bag disposed in the bag receiving portion, the sealing arrangement comprising two sealing members defining a sealing region in which material of the bag is clamped to effect sealing.

3. The blending device as claimed in claim 1, in which the holding arrangement is arranged for movement relative to the bag receiving portion between a retracted position in which the holding arrangement is spaced apart from the bag receiving portion and an extended position in which the holding arrangement is located adjacent the bag receiving portion for holding the sample bag disposed in the bag receiving portion.

4. The blending device as claimed in claim 1, in which the bag manipulation arrangement comprises a mounting arrangement to which the holding arrangement is mountable, and a controlling arrangement coupled to the mounting arrangement for controlling movement of the holding arrangement relative to the bag receiving portion between retracted and extended positions.

5. The blending device as claimed in claim 1, in which the driving arrangement comprises a plurality of arms, wherein the first abutment member is located towards an end of a first arm and the second abutment member is located towards an end of a second arm.

6. The blending device as claimed in claim 5, in which the driving arrangement comprises cam arms, the first abutment member being mounted to the first arm by a first cam arm and the second abutment member being mounted to the second arm by a second cam arm, wherein at least one of the first cam arm and the second cam arm is pivotally mounted to the respective arm.

7. The blending device as claimed in claim 6, in which the first abutment member comprises a first roller and the second abutment member comprises a second roller, at least one of the first and second rollers being rotatably supported on one of the respective arm and the respective cam arm.

8. The blending device as claimed in claim 1, in which the bag manipulation arrangement is resiliently abuttable against the wall of the sample bag when the sample bag is disposed in the bag receiving portion.

9. The blending device as claimed in claim 1, in which the abutment members are configured to move asymmetrically when the abutment members are abutting the wall of the sample bag when the sample bag is disposed in the bag receiving portion.

10. The blending device as claimed in claim 1, in which at least one of the first abutment member and the second abutment member comprises a friction enhancing material for enhancing friction between the respective abutment member and the wall of the sample bag as to minimize slipping of the first and second abutment members against the wall of the sample bag.

11. The blending device as claimed in claim 10, wherein the friction enhancing material comprises a plastic based paint.

12. The blending device as claimed in claim 5, in which the first arm and the second arm are pivotally mounted to the mounting arrangement such that they are relatively movable thereto between a first position and a second position, wherein the abutment members are spaced further apart from one another in the first position than in the second position, and in which the driving arrangement comprises at least one arm biasing arrangement for biasing at least one of the first arm and the second arm towards the first position.

13. The blending device as claimed in claim 4, in which the mounting arrangement is slidably movable relative to the bag receiving portion under control of the controlling arrangement so as to control movement between the retracted position and the extended position.

14. The blending device as claimed in claim 5, in which the driving arrangement comprises a lever arm, wherein the first arm and the second arm are coupled to the level arm, the lever arm being pivotally mounted to the mounting arrangement such that pivoting of the lever arm relative to the mounting arrangement is configured to cause the first and second arms to move between a first position and a second position, wherein the abutment members are spaced further apart from one another in the first position than in the second position, and wherein an arm biasing arrangement is coupled to the lever arm and configured to bias the first arm and the second arm towards the first position.

15. The blending device as claimed in claim 14, in which the driving arrangement comprises a trigger arm, wherein the trigger arm is provided towards one end of the lever arm, the trigger arm being pivotally coupled to the lever arm such that the trigger arm is movable between a rest position and a rotated position, wherein relative pivotal movement between the trigger arm and the lever arm has a defined end point at the rest position beyond which the trigger arm will not pivot relative to the lever arm further in a first pivotal direction, and wherein the driving arrangement comprises a trigger biasing arrangement for biasing the trigger arm in the first pivotal direction towards the rest position.

16. The blending device as claimed in claim 4, in which the mounting arrangement comprises a first mounting portion and a second mounting portion arranged for relative movement between the first mounting portion and the second mounting portion, the holding arrangement being provided on the first mounting portion, and the second mounting portion comprising a coupling arrangement for coupling movement of the controlling arrangement to the holding arrangement, and in which the mounting arrangement is arranged such that movement of the second mounting portion in a first direction relative to the first mounting portion causes the coupling arrangement to cause the driving arrangement to move from a first position to a second position, wherein the abutment members are spaced further apart from one another in the first position than in the second position, and such that movement of the second mounting portion in an opposite second direction relative to the first mounting portion causes the coupling arrangement to cause the driving arrangement to move from the second position to the first position.

17. The blending device as claimed in claim 1, in which the bag manipulation arrangement comprises a guide portion for guiding a portion of the wall of the sample bag.

18. The blending device as claimed in claim 1, in which the blending device comprises a diluent dispensing arrangement comprising a reservoir for receiving a source of diluent, a dispensing nozzle and a fluid connection path between the reservoir and the dispensing nozzle, wherein the dispensing nozzle is arranged for dispensing diluent towards the bag receiving portion.

19. The blending device as claimed in claim 4, in which the blending device is arranged such that relative movement of the mounting arrangement and the bag receiving portion towards one another seals the bag disposed in the bag receiving portion, in which the mounting arrangement comprises a first sealing member and the bag receiving portion comprises a second sealing member, the first and second sealing members being arranged to cooperate for sealing the bag, and in which one of the first sealing member and the second sealing member comprises at least one projecting portion and the other of the first sealing member and the second sealing member comprises at least one complementary receiving recess to provide a convoluted sealing region into which material of the bag will be drawn during clamping so tending to draw a remainder of the bag towards the first and second sealing members.

20. The blending device as claimed in claim 1, comprising a control system for controlling operation of the blending device, wherein when the sample bag containing the sample is disposed in the bag receiving portion, the control system is configured to control a complete blending operation, and wherein the control system controls the bag manipulation arrangement for acting on the sample bag disposed in the bag receiving portion.

21. The blending device as claimed in claim 20, in which the control system comprises at least one of a programmable and user operable control.

22. The blending device as claimed in claim 1, in which the kneading arrangement comprises at least one reciprocating paddle arranged for acting on the wall of the sample bag disposed in the bag receiving portion, the paddle comprising a paddle arm arranged for mounting the paddle to a reciprocating mechanism, the paddle arm comprising a paddle arm mounting arrangement arranged such that the paddle is replaceably mountable to and removable from the reciprocating mechanism by a user.

23. The blending device as claimed in claim 22, in which one of the paddle arm mounting arrangement and a portion of the reciprocating mechanism comprises a protrusion, and the other of the paddle arm mounting arrangement and a portion of the reciprocating mechanism comprises a recess, the protrusion being arranged to be receivable into the recess for mounting the paddle to the reciprocating mechanism.

* * * * *